United States Patent [19]

Lin

[11] Patent Number: 5,009,089

[45] Date of Patent: Apr. 23, 1991

[54] DOUBLE HOOK-BOLT UNIT LOCK

[76] Inventor: Emily M. Y. Lin, No. 112, Sze Chuan Rd., Sec. 1, Panchiao City, Taipei Hsien, Taiwan

[21] Appl. No.: 429,620

[22] Filed: Oct. 31, 1989

[51] Int. Cl.[5] ..... E05B 63/14

[52] U.S. Cl. ..... 70/114; 70/143; 70/134; 292/49

[58] Field of Search ..... 70/113, 114, 116, 118, 70/120, 121, 123, 130, 137, 139, 143, 134, DIG. 68, DIG. 69, DIG. 78, DIG. 79; 292/5, 8, 27, 49, 116, 117, 156, 159

[56] References Cited

U.S. PATENT DOCUMENTS

| | | | |
|---|---|---|---|
| 1,264,814 | 4/1918 | Kornstein | 70/114 X |
| 1,439,332 | 12/1922 | Schulte | 70/143 |
| 1,530,655 | 3/1925 | Dowling | 70/114 X |
| 1,673,468 | 6/1928 | Palinkas | 70/120 |
| 1,730,011 | 10/1929 | Kohn | 70/116 X |
| 2,055,913 | 9/1936 | Schwarz | 70/143 |
| 2,058,517 | 10/1936 | Schoorel | 70/143 |
| 3,904,230 | 9/1975 | Fane et al. | 292/49 |
| 4,623,175 | 11/1986 | Carroll | 70/143 X |
| 4,656,849 | 4/1987 | Rotondi et al. | 70/143 X |
| 4,739,638 | 4/1988 | Lin | 70/143 X |

FOREIGN PATENT DOCUMENTS

| | | | |
|---|---|---|---|
| 30832 | 11/1907 | Austria | 70/116 |

*Primary Examiner*—Robert L. Wolfe
*Assistant Examiner*—Suzanne L. Dino
*Attorney, Agent, or Firm*—Asian Pacific International Patent and Trademark Office

[57] ABSTRACT

A double hook-bolt unit lock includes a lock barrel having a revolving rod connected thereto to cause a cam wheel assembly to move simultaneously so as to drive the stop keys of a stop frame assembly away from the upper notched portion of a brake frame assembly and to let the cam wheel assembly move the brake frame assembly rectilinearly via a lower notched portion of the frame assembly. By means of the push force from L-shaped guide slots of the side plates of a lockcasing and the guidance of oblique guide slots of a brake frame assembly, the two L-shaped bolts which are movably connected to the brake frame assembly are driven to smoothly into respective locking positions to lock the door.

4 Claims, 4 Drawing Sheets

DOUBLE HOOK-BOLT UNIT LOCK

BACKGROUND OF THE INVENTION

Regular locking device generally utilizes a latch bolt having a rectilinear motion, or a hook bolt having a circular motion so as to lock or unlock a door. The former tends to be damaged or deformed while the latter is more difficult to drive in the notch of an associated striking plate. The hook bolt may produce noise during its operation.

The lock which locks a door by means of a rectilinear motion of the latch bolt may be easily destroyed by a burglar through violence. In a regular one-step locking device, the single latch bolt is driven to insert only a short distance into the notch of a striking plate mounted on a door frame. Through severe impact force against the door, the door panel and the latch bolt will be easily deformed, and the latch bolt will be pushed out of the associated striking plate to unlock the door (This is commonly seen in TV programs). In regular two or three-step locking device (which comprises two or three latch bolts), the door still cannot be well protected against violence. Although the latch bolts are inserted more deeply in the notches of a striking plate, the motion range of the latch bolts into the notches of a striking plate is still limited by the thickness of a door frame. If a regular two or three-step locking device is used to lock a door, a burglar may hit the door, open it after having inserted a crowbar into the gap between the door panel and the associated door frame (in order to facilitate the turning of a door panel against a door frame, a gap and possible tolerance must be remained therebetween) to pry the door panel in or out to a certain extent.

SUMMARY OF THE INVENTION

The main object of the present invention is to provide a double hook-bolt unit lock which utilizes a pair of L-shaped bolts to accurately and firmly lock up with a striking plate so as to better withstand damage by violence or a crowbar.

Another object of the present invention is to provide such a double hook-bolt unit lock wherein the two L-shaped bolts, after having been pushed into the notch of a striking plate mounted on a door frame, will be forced by the L-shaped guide slots of the side plates of the casing and by the oblique guide slots of a brake frame assembly to move apart outwardly in a vertical direction, thereby enabling the brake frame assembly to become firmly engaged with the striking plate which is fixedly mounted on the associated door frame. A sloped portion of the protruding front end of the brake frame assembly helps to reinforce the structure and to protect the lock against insertion therein of a crowbar.

BRIEF DESCRIPTION OF THE DRAWINGS

The invention as well as its many advantages may be further understood by reference to the following detailed description and drawings in which.

DETAILED DESCRIPTION OF THE PREFERRED EMBODIMENT

Figure 1:
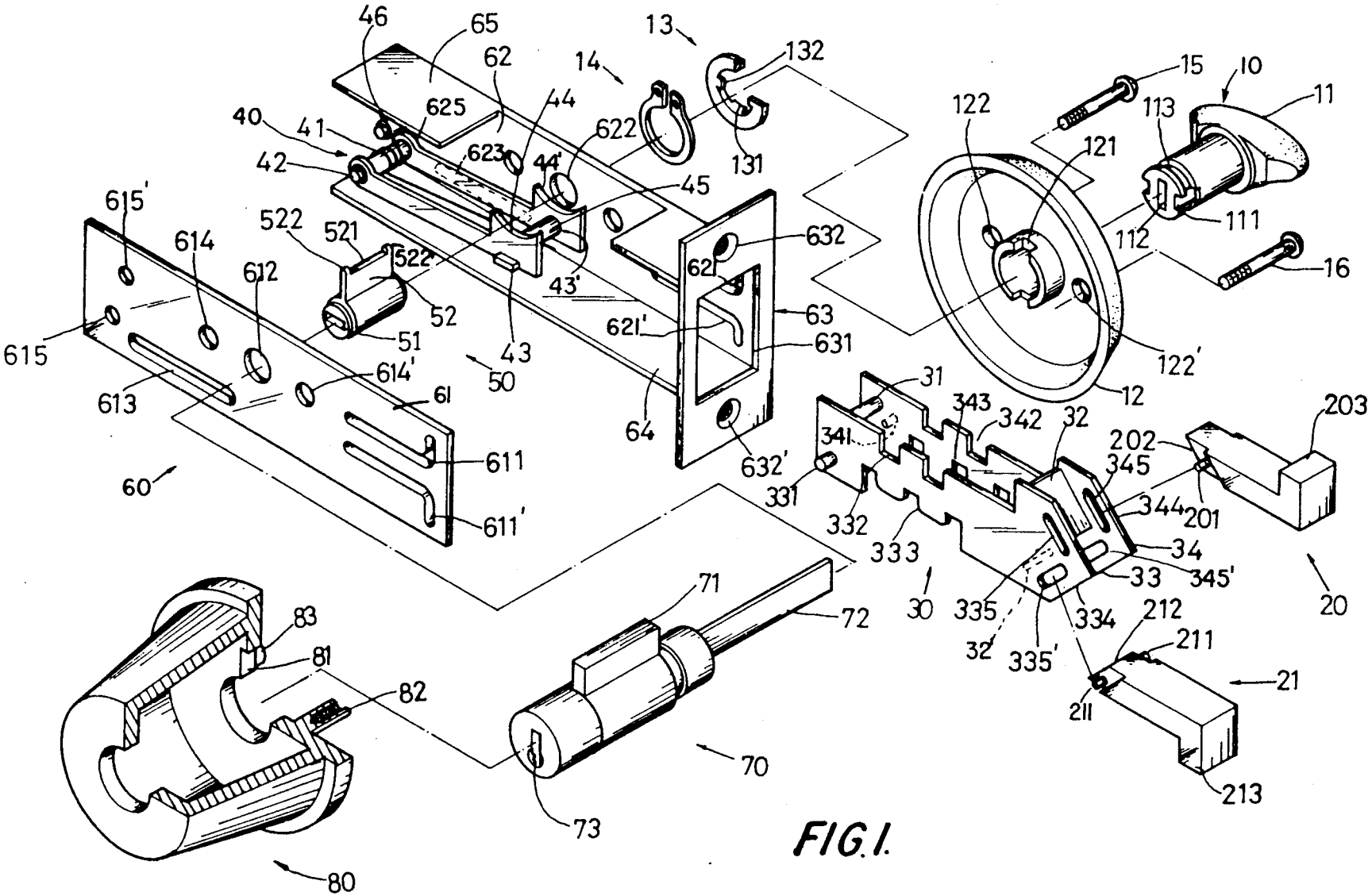
FIG. 1 is a perspective exploded view of a double hook-bolt unit lock embodying the present invention.

Turning now to the annexed drawings in detail and first referring to FIG. 1, therein illustrated is a unit lock embodying the present invention and generally comprised of a lock barrel (70), an outer cylindrical cap (80), an inner knob assembly (10), a casing (60), a cam wheel element (50), a stop frame assembly (40), a brake frame assembly (30), two L-shaped bolts (20) and (21), and a stop spring (41).

The lock barrel (70) comprises a movable key (71), a revolving rod (72) and a key hole (73).

The outer cylindrical cap (80) comprises a key slot (81) for positioning therein of the movable key (71), and two fixed screw holes (82) and (83) for connection of a pair of screw elements (15) and (16).

The inner knob assembly (10) is comprised of a knob (11), an inner cap (12), a C-ring (13), and a retainer ring (14). The knob (11) comprises two notches (111) for seating therein of the two horizontal key portions (131) of the C-ring (13) respectively, a rectangular slot (112) for insertion therein of the revolving rod (72) of the lock barrel (70), and a circular groove (113) for mounting thereon of the retainer ring (14). The inner cap (12) comprises two opposite notches (121) made on its central hollow shaft for seating therein of the two vertical key portions (132) of the C-ring (13) respectively, and two round holes (122) and (122') for insertion therethrough of two screw elements (15) and (16) to screw up with the two screw holes (82) and (83) of the outer cylindrical cap (80).

The casing (60) is comprised of two opposite side plates (61) and (62), a face plate (63), a bottom plate (64) and an upper plate (65). The two opposite side plates (61) and (62) are symmetrical, each comprising two L-shaped guide slots (611) and (611') or (621) and (621'), a fixed hole (612) or (622), a rectilinear guide slot (613) or (623), two screw holes (614) and (614') or (624) and (624'), and two pin holes (615) and (615') or (625) and (625'). The face plate (63) comprises a rectangular hole (631) for passing therethrough of the two L-shaped bolts (20) and (21), and two round holes (632) and (632') for insertion therethrough of two screw elements to fix the face plate (63) to a door panel.

The cam wheel assembly (50) has both ends respectively set in the fixed holes (612) and (622) of the two opposite side plates (61) and (62) to pivot therebetween, and comprises a key hole (51) for insertion therein of the revolving rod (72) of the lock barrel (70), and a thrust arm (52) having a notch 521 thereon to define two projecting ends (522) and (522').

The stop frame assembly (40) comprises two stop keys (43) and (43') and two curved sliding ways (44) and (44'), and is supported by a cross rod (45) at the front end and a lock pin (42) at the back end, which lock pin (42) is fixedly mounted on the casing (60) with both ends respectively inserted in the pin holes (615) and (625) of the two opposite side plates (61) and (62).

Figure 2:
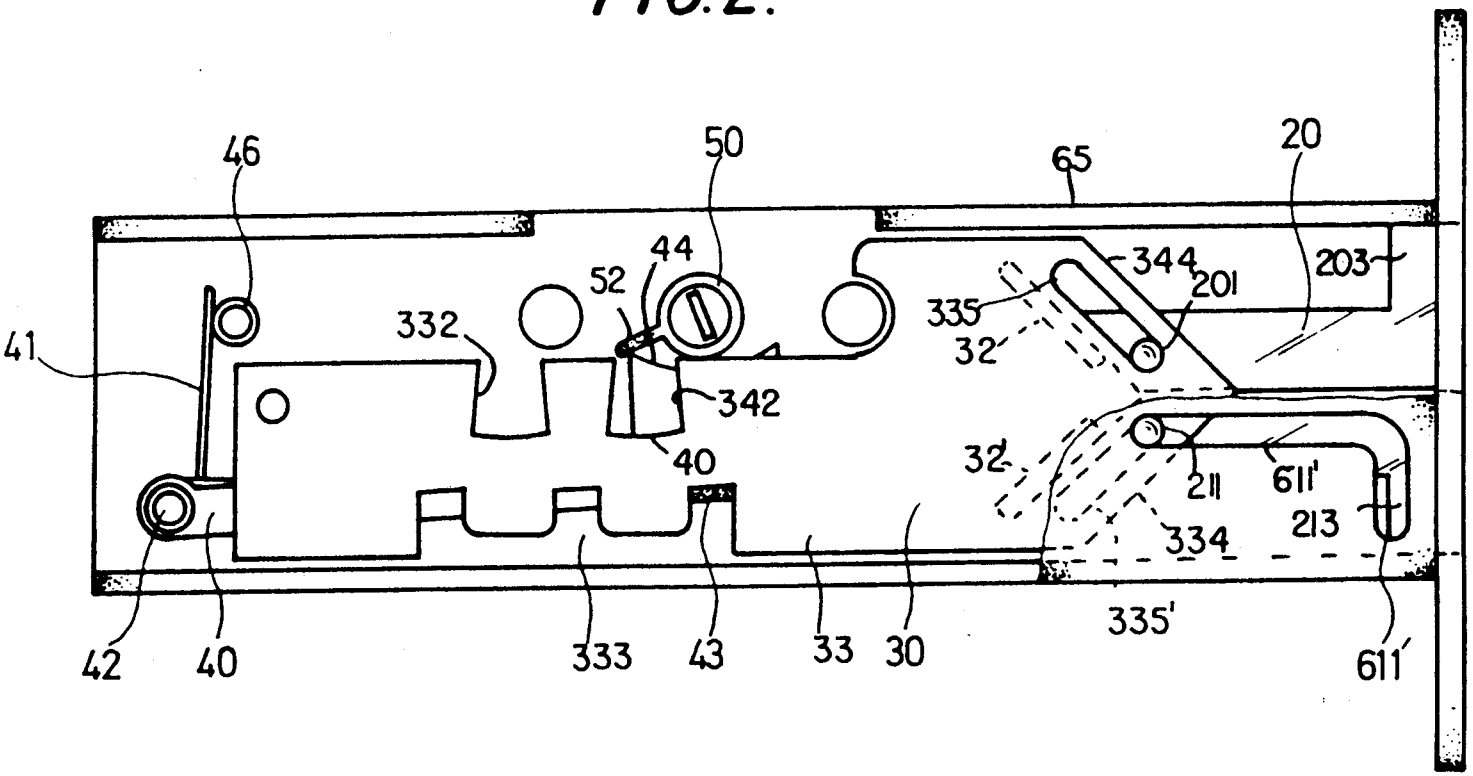
FIG. 2 is a schematic drawing of the present invention when it is not in action.
Figure 3:
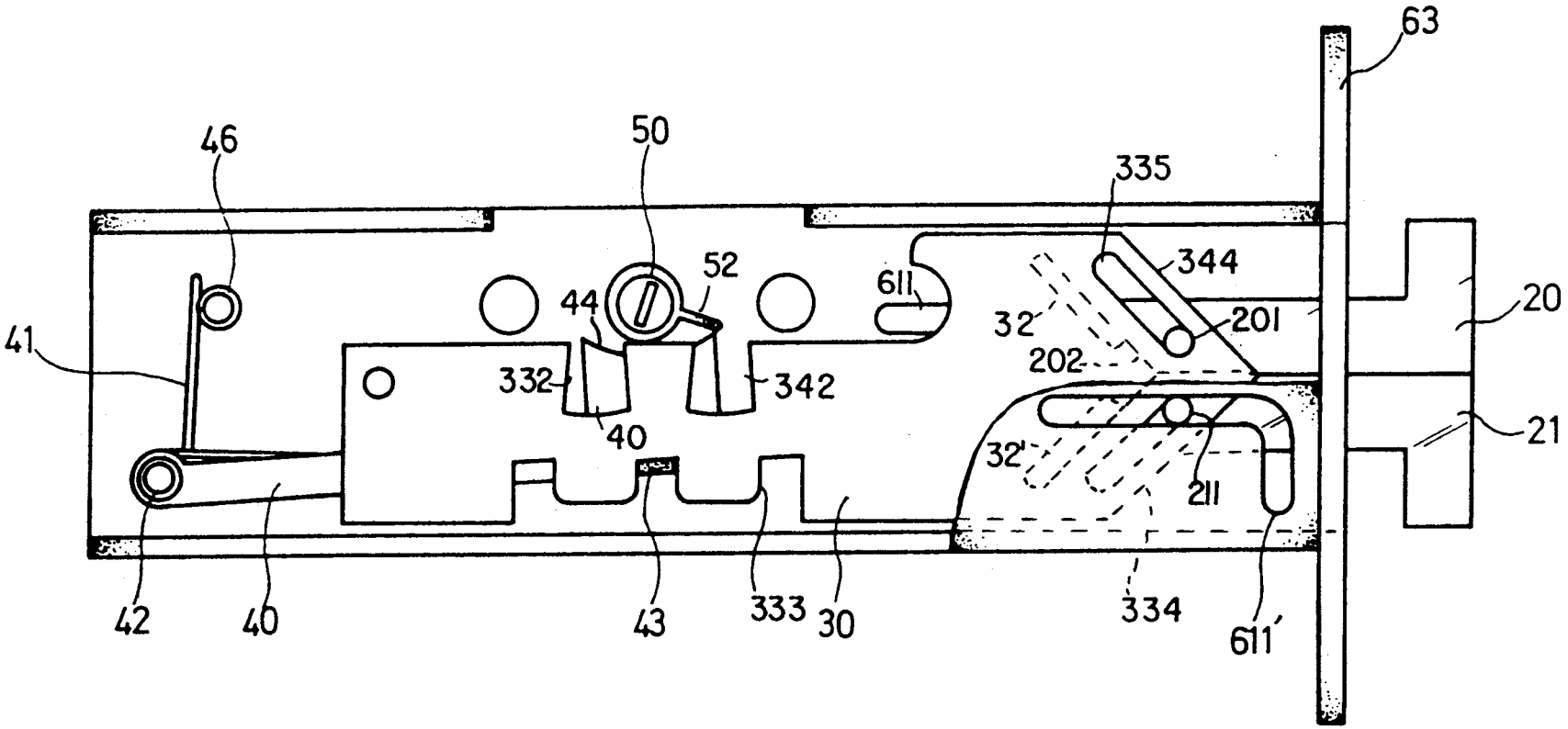
FIG. 3 is a schematic drawing of the present invention, illustrating the location of the component parts under first step motion.
Figure 4:
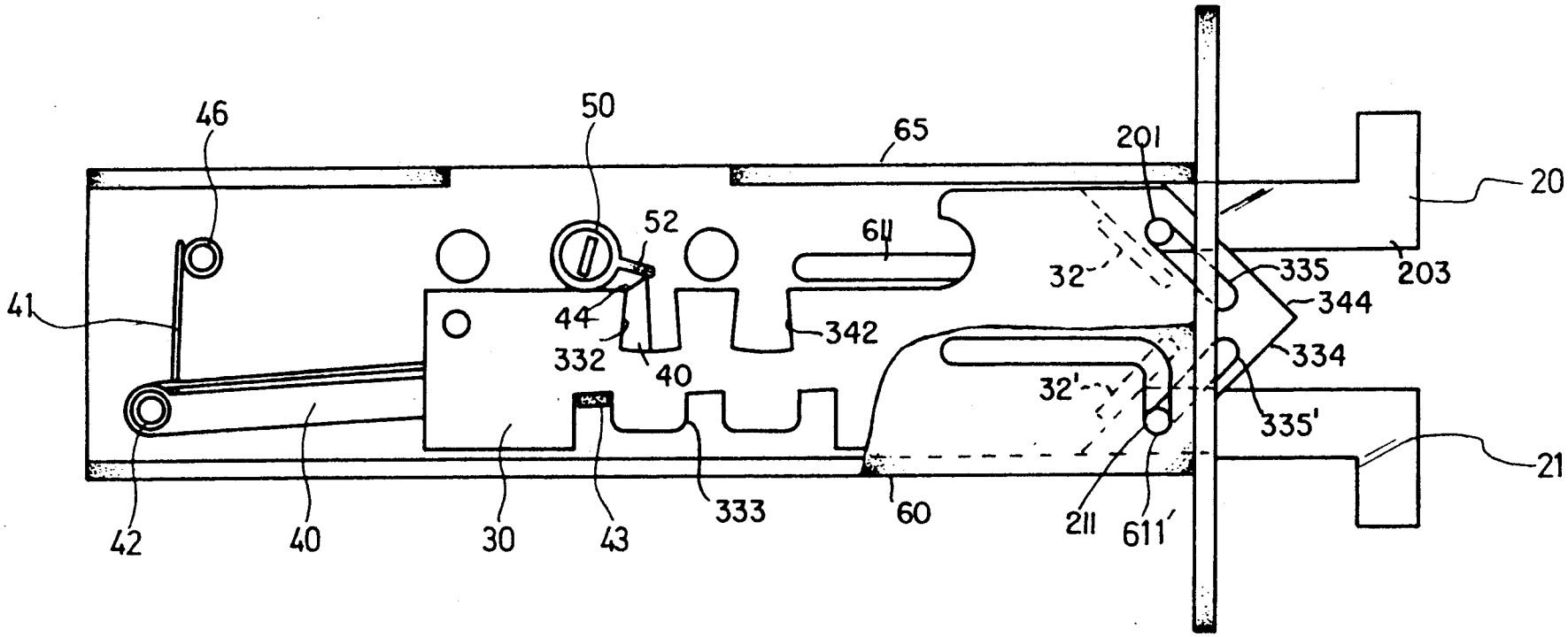
FIG. 4 is a schematic drawing of the present invention, illustrating the location of the component parts under second step motion.

The brake frame assembly (30) is comprised of two brake plates (33) and (34) connected by a connecting pin (31) and two connecting plates (32) and (32') respectively set therebetween. The two brake plates (33) and (34) are symmetrical, of which each comprises a dowel (331) or (341), an upper notched portion forming drive notches (332) or (342), a lower notched portion forming latches notches (333) or (343), a symmetrical slope portion (334) or (344), and two guide slots (335) and (335') or (345) and (345'). As seen in FIGS. 2 through 4, the guide slots are angled to one another in an arrow configuration. The two connecting plates (32) and (32') are respectively disposed in parallel with the slope portions (334) and (344) and the guide slots (335) (335') and (345) (345') of the two opposite brake plates (33) and (34). The two dowels (331) and (341) of the two brake plates (33) and (34) are movably set in the rectilinear guide slots (613) and (623) of the two opposite side plates (61) and (62) of the casing (60) respectively to permit the brake frame assembly (30) to have rectilinear motion.

The two L-shaped bolts (20) and (21) are respectively connected to the brake frame assembly (30) movably set in the two brake plates (33) and (34) by means of two lock pins (201) and (211) inserted through the guide slots (335) (335') and (345) (345') of the brake frame assembly (30) and the L-shaped guide slots (611) (611') and (621) (621') of the two opposite side plates (61) and (62), of which each comprises a slope portion (202) or (212) made at one end and a hook end (203) or (213) made at the other end. The slope portions (202) and (212) of the two L-shaped bolts (20) and (21) are to respectively match with the angle of inclination of the connecting plates (32) and (32') for sliding while the hook ends (203) and (213) are to lock up with a striking plate mounted on a door frame.

The stop spring (41) is mounted on the lock pin (42) of the stop frame assembly (40) having one end stopped by cross rod (45) of the stop frame assembly (40) at the bottom and having the other end stopped against the undersurface of a supporting rod (46) mounted on the side plate (62), such that an upward pressure is constantly applied to the stop frame assembly (40) to force the stop keys (43) and (43') respectively to set in the the lower notched portions (333) and (343).

The operation of the present invention is outlined hereinafter with reference made to FIGS. 2 through 4. When a correct key is inserted into the key hole (73) of the lock barrel (70) and turned round, the thrust arm (52) of the cam wheel assembly (50) is immediately cause to rotate [because the revolving rod (72) of the lock barrel (70) is inserted into the key hole (51) of the cam wheel assembly (50) and the rectangular slot (112) of the knob (11)] to further drive the stop frame assembly (40) to move so as to carry the stop keys (43) and (43') to break away from the lower notched portions (333) and (343) of the brake frame assembly (30), and the two projecting ends (522) and (522') of the cam wheel assembly (50) are respectively set in the upper notched portions (332) and (342) to move the brake frame assembly (30). If the key is not properly turned along the right direction after having been inserted into the key hole (73), the projecting ends (522) and (522') will be stopped against the brake frame assembly (30) and the lock will be unable to lock out. When the lock barrel (70) is driven to rotate by a correct key to a first step position (FIG. 3), the two L-shaped bolts (20) and (21) are driven to move forward along rectilinear direction. If the cam wheel assembly (50) is continuously driven to rotate, the two L-shaped bolts (20) and (21) will be forced by the L-shaped guide slots (611) (611') and (621) (621') of the two opposite side plates (61) and (62) of the casing (60) and guided by the oblique guide slots (335) (335') and (345) (345') of the brake frame assembly (30) to respectively move apart outwardly in the vertical direction against the brake frame assembly (30) so as to firmly engage with a striking plate (not shown) so as to firmly lock the door.

FIG. 4 shows bolts 20 and 21 in their locking positions.

FIG. 2 shows lock bolts 20 and 21 in their retracted positions. Stop Key 43 is engaged in the rightmost notch 333, thereby holding brake frame assembly 30 in a retracted position wherein slots 335 and 335' have their right ends engaged with lock pins 201 and 211. Stop key 43 (and its companion key 43') prevent frame assembly 30 from moving to the right; frame assembly 30 prevents lock bolts 20 and 21 from moving to the right.

FIG. 3 shows lock bolts 20 and 21 projecting rightwardly for extension from brake frame assembly for extension through an opening in a non-illustrated striker plate. Cam wheel assembly 50 is turned counterclockwise to move the components from the FIG. 2 position to the FIG. 3 position. Arm 52 swings in a downward arc so that the edge thereof defined by notch 521 slides along curved cam surface 44 of the stop frame assembly 40, thereby moving stop key 43 downwardly out of the rightmost notch 333. Projecting end 522 of arm 52 engages the right edge of notch 342 to move frame assembly 40 to the FIG. 3 position. Plates 32 and 32' drive lock bolts 20 and 21 to the FIG. 3 positions.

FIG. 4 shows lock bolts 20 and 21 projected rightwardly (compared to FIG. 3) and also spread apart so as to have locking engagements with the concealed faces of the nonillustrated striker plate. Rotary motion of wheel assembly 50 provides the impetus for moving bolts 20 and 21 to the FIG. 4 position (one complete revolution), the end of arm 52 depresses frame assembly 40 so that key 43 moves downwardly out of the central notch 333 in brake frame assembly 30. Projecting end 522 of arm 52 strikes the right edge of notch 332 to move brake frame assembly 30 to the FIG. 4 position.

As assembly 30 approachess the FIG. 4 position, pins 201 and 211 reach the vertical portions of L-shaped slots 611 and 611' in stationary plate 61. Further rightward motion of brake frame assembly 30 causes plates 32 and 32' to drive the bolts 20 and 21 apart. The lock bolts and brake frame assembly 30 are retained in the FIG. 4 positions by stop key 43 extending into the leftmost notch in assembly 30.

According to the present invention, the C-ring (13) which is mounted on the knob (11) may be turned to let its vertical key portions (132) respectively seat in the notches (121) of the inner cap (12) to let the lock be locked out internally such that nobody can unlock the lock with a key or device from outside.

Having described my invention as related to the embodiment shown in the accompanying drawings, it is my intention that the invention be not limited by any of the details of description, unless otherwise specified, but rather be constructed broadly within its spirit and scope as set out in the appended claims.

What is claimed is:

1. A double hook-bolt unit lock, including:

a lock casing (60) having an upper L-shaped guideslot means (611) and a lower L-shaped guide slot means (611'), each guide slot means having horizontal slot portions and vertical slot portions;

a rotary cam wheel assembly (50) located within said lock casing for rotational movement around a horizontal axis, said wheel assembly comprising a swingable arm (52);

a stop frame assembly (40) that includes a vertically movable wall mechanism having a curved cam surface (44) slidably and camingly engaged with said swingable arm, whereby swinging motion of said arm around the aforementioned horizontal axis causes said wall mechanism to reciprocate vertically, said wall mechanism including a stop key means (43) located below said curved cam surface;

a brake frame assembly (30) slidably mounted within said lock casing for rectilinear horizontal motion at right angles to the cam wheel assembly rotational axis; said brake frame assembly comprising a vertically oriented plate means (33) having an upper cam slot (335) and a lower cam slot (335'), said cam slots being acutely angled to the horizontal midplane of the plate means in an arrow configuration; said brake frame assembly having two drive notches (332 and 342) registering with said swingable arm, and three latching notches (at 333) in registry with said stop key means;

two L-shaped lock bolts (20, 21) slidably mounted within the lock casing for movement between retracted positions located entirely within the lock casing and extended positions projecting from the lock casing; each lock bolt having a horizontal leg and a vertical leg, the lock bolts being arranged one above the other, with the vertical legs thereof facing away from each other; each lock bolt having lock pin means (201 or 211) extending from the respective horizontal leg through the associated cam slot in the brake frame assembly and the associated guide slot means in the lock casing;

the drive notches and latching notches in the brake frame assembly being oriented so that when the cam wheel assembly is rotated the stop key means (43) is released from the associated latching notch before the swingable arm interacts with an associated drive notch to import motion to the brake frame assembly;

the lock pin means on the lock bolts being in simultaneous engagement with the L-shaped guide slot means in the lock casing and the angled slots in the brake frame, so that when the brake frame assembly is moved to a point where said lock pin means reached the vertical slot portions of the L-shaped guide slots, further motion of the brake frame assembly enables the angled slots to guide said lock pin means into and along the vertical slot portions, whereby the lock bolts are moved vertically away from each other.

2. The lock of claim 1, wherein said rotary cam wheel assembly is key-operated.

3. The lock of claim 1, wherein said brake frame assembly comprises two flat cam elements (32, 32') extending angularly to each other and parallel to said cam slots; said lock bolts having end surfaces (202 and 212) mated to said cam elements for keeping the horizontal legs of the lock bolts parallel when the lock bolts are being spread apart.

4. A double hook-bolt unit lock comprising: a lock casing (60) defining a horizontal slideway;

a rotary cam wheel assembly (50) located within said lock casing for rotational movement around a horizontal axis extending transverse to said horizontal slideway; said wheel assembly comprising an arm (52) swingable in a vertical arc;

a stop frame assembly (40) having a curved cam surface (44) engaged with the swingable arm, and a stop key means (43) movable vertically as a response to interaction between the swingable arm and curved cam surface;

a brake frame assembly (30) slidably mounted within said lock casing for movement along the horizontal slideway; said brake frame assembly having a plural number of drive notches (332 and 342) in registry with said swingable arm, and a plural number of latching notches (at 333) in registry with said stop key means;

two L-shaped lock bolts (20,21) slidably mounted within the lock casing; and drive connections between the brake frame assembly and lock bolts for causing the bolts to separate from one another as they are moved by the brake frame assembly between retracted positions located entirely within the lock casing and extended positions projecting from the lock casing;

said drive notches (332 and 342) and said latching notches (at 333) being oriented so that when the cam wheel assembly is rotated the stop key means (43) is released from the associated latching notch before the swingable arm (52) interacts with an associated drive notch to import motion to the brake frame assembly; said key means being located within a latching notch to prevent movement of the brake frame assembly.

* * * * *